US006598769B1

(12) United States Patent
Franco

(10) Patent No.: US 6,598,769 B1
(45) Date of Patent: Jul. 29, 2003

(54) SOCK HOLDING DRESSING AID

(76) Inventor: Rito H. Franco, 29384 Dorsey St., Sun City, CA (US) 92586

( * ) Notice: Subject to any disclaimer, the term of this patent is extended or adjusted under 35 U.S.C. 154(b) by 0 days.

(21) Appl. No.: 10/171,922

(22) Filed: Jun. 14, 2002

(51) Int. Cl.[7] ..... A47G 25/90
(52) U.S. Cl. ..... 223/112; 223/118
(58) Field of Search ..... 223/112, 118

(56) References Cited

U.S. PATENT DOCUMENTS

| | | | | |
|---|---|---|---|---|
| 5,626,269 A | | 5/1997 | Duarte | |
| 5,706,988 A | * | 1/1998 | Moore | 223/111 |
| 5,799,844 A | * | 9/1998 | James | 223/111 |
| 5,826,761 A | * | 10/1998 | Basaj | 223/111 |
| 5,894,970 A | * | 4/1999 | Belkin et al. | 223/112 |
| 5,909,831 A | * | 6/1999 | Griffin | 223/111 |
| 6,276,578 B1 | | 8/2001 | Stenger | |

* cited by examiner

*Primary Examiner*—John J. Calvert
*Assistant Examiner*—James G Smith

(74) *Attorney, Agent, or Firm*—Loyal McKinley Hanson

(57) ABSTRACT

A sock-holding dressing aid for a person to use in donning a sock having a cuff onto a foot of the person includes a U-shaped member for holding the cuff of the sock in an expanded position ahead of the foot of the user in order to facilitate insertion of the foot into the sock, the U-shaped member having a semicircularly shaped base portion and first and second side portions extending forwardly from the semicircularly shaped base portion. First and second straps are connected to respective ones of the first and second side portions of the U-shaped member to enable the person to pull the U-shaped member toward the person in order to pull the sock onto the foot of the person without the person having to bend over toward the foot. The first and second straps are composed of a flexible material such that the user can wind the straps around the U-shaped member into a storage configuration. The U-shaped member includes a first and second flanges that extend sidewardly from respective ones of the first and second side portions of the U-shaped member where they function to grip the cuff of the sock while also facilitating release of the cuff by action of the person tilting the base portion of the U-shaped member downwardly.

5 Claims, 3 Drawing Sheets

SOCK HOLDING DRESSING AID

BACKGROUND OF THE INVENTION

1. Technical Field

This invention relates generally to geriatrics and other conditions making it difficult for people to bend over for dressing purposes. It relates more particularly to a sock holding dressing aid that facilitates the task of donning a sock.

2. Description of Related Art

Various sock holding devices (sock holders) exist in the prior art. They aid users put on their socks without having to bend over. Reference may be made to U.S. Pat. Nos. 3,860,156; 4,482,084; 5,050,783; 5,626,269; 5,636,774; 5,687,889; 5,799,844; and 6,276,578 for a sampling. All the various sock holder designs described in those patents and elsewhere indicate that the need for a sock holder is well recognized. However, just the right combination of feel, functionality, ease of use, cost, and appearance remains elusive, and so the need for a suitable sock holder continues.

SUMMARY OF THE INVENTION

It is an object of the present invention to overcome some of the drawbacks of prior art sock holders. This object is achieved by providing a sock holding dressing aid having a resiliently deformable U-shaped sock-holding member with cuff-engaging flanges and flexible straps. The cuff-engaging flanges are easy to position so that they securely hold the cuff of a sock open, while being easily removed from the cuff once the sock is on the user's foot. The flexible straps are convenient to use in pulling the sock onto the foot, while being readily rolled up around the U-shaped member for storage in a compact configuration suitable for the dresser drawer or luggage.

To paraphrase some of the more precise language appearing in the claims, a sock-holding dressing aid constructed according to the invention, for a person to use in donning a sock having a cuff onto a foot of the person, includes means for holding the cuff of the sock in an expanded position ahead of the foot of the user in order to facilitate insertion of the foot into the sock. The means for doing so includes a U-shaped member having a semicircularly shaped base portion and first and second side portions extending forwardly from the semicircularly shaped base portion. The sock-holding dressing aid also includes means for enabling the person to pull the U-shaped member toward the person in order to pull the sock onto the foot of the person without the person having to bend over toward the foot. That is accomplished with first and second straps connected to respective ones of the first and second side portions of the U-shaped member.

According to one aspect of the invention, the first and second straps are composed of a flexible material such that the user can wind the straps around the U-shaped member into a storage configuration. According to another aspect, the U-shaped member includes means for gripping the cuff of the sock in the form of first and second flanges that extend sidewardly from respective ones of the first and second side portions of the U-shaped member. They function to grip the cuff of the sock while also facilitating release of the cuff by action of the person tilting the base portion of the U-shaped member downwardly. Preferably, the U-shaped member is composed of a resiliently deformable material (e.g., metal) such that the user can resiliently deform the U-shaped member slightly from a non-deformed shape in order to place the cuff of the sock over the flanges, and then allow the U-shaped member to recover toward the non-deformed shape and thereby hold the cuff in the expanded position.

Thus, the invention provides a sock holder having better combination of feel, functionality, ease of use, cost, and appearance. The following illustrative drawings and detailed description make the foregoing and other objects, features, and advantages of the invention more apparent.

DESCRIPTION OF THE PREFERRED EMBODIMENTS

Figure 1:
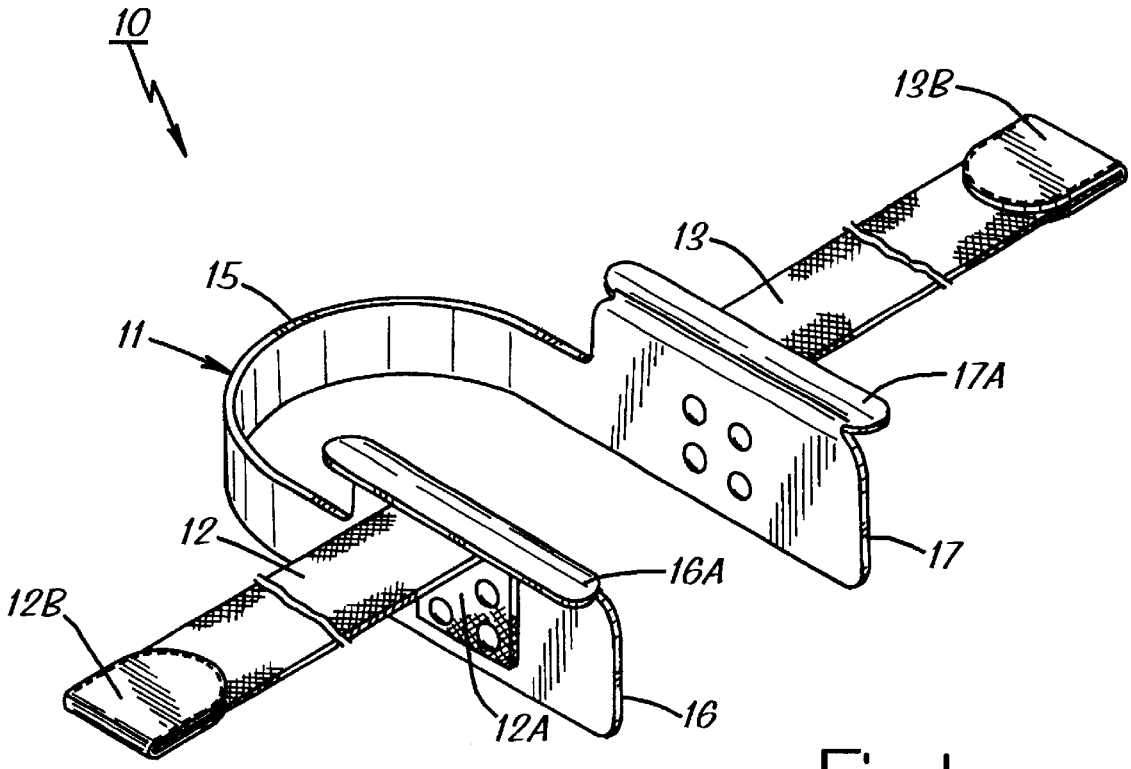
FIG. 1 of the drawings is an isometric view showing the front, top, and right side of a sock holding dressing aid constructed according to the invention, with the straps foreshortened for illustrative convenience.
Figure 2:
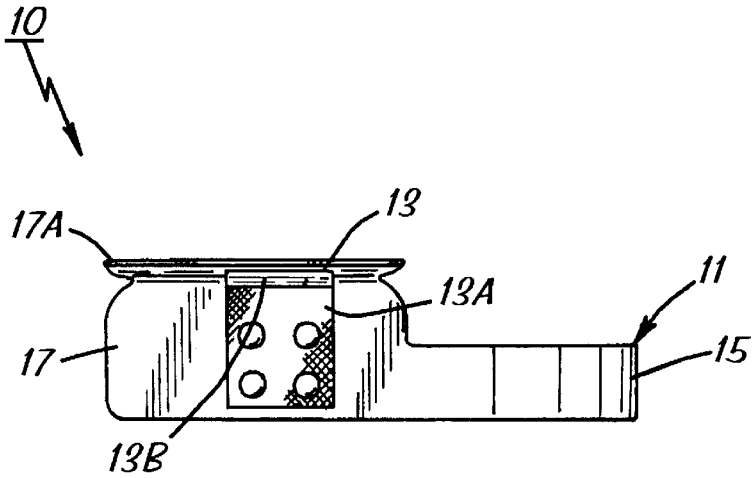
FIG. 2 is an elevation view of the left side of the sock holding dressing aid.
Figure 3:
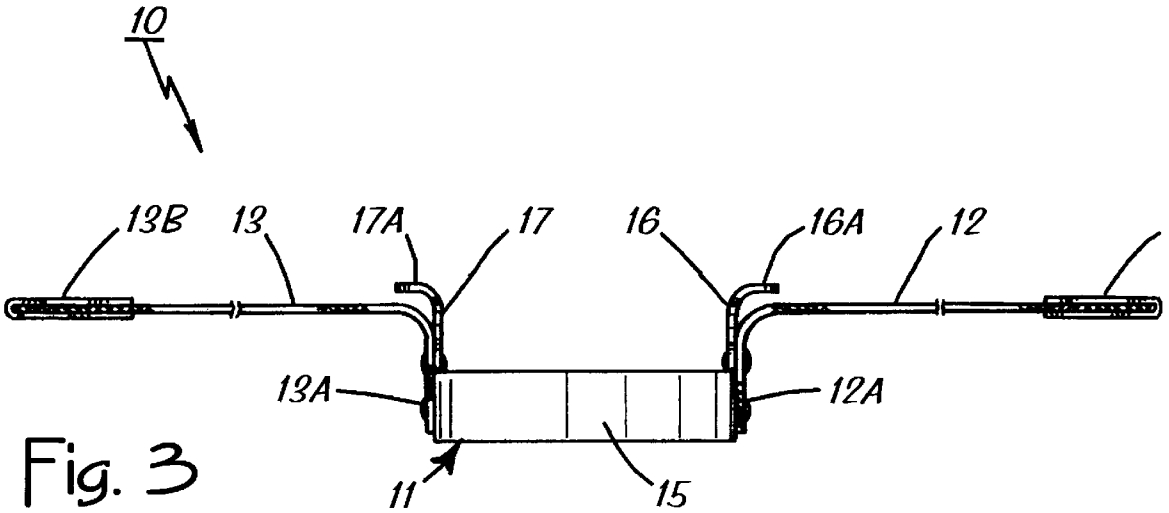
FIG. 3 is an elevation view of the back.
Figure 4:
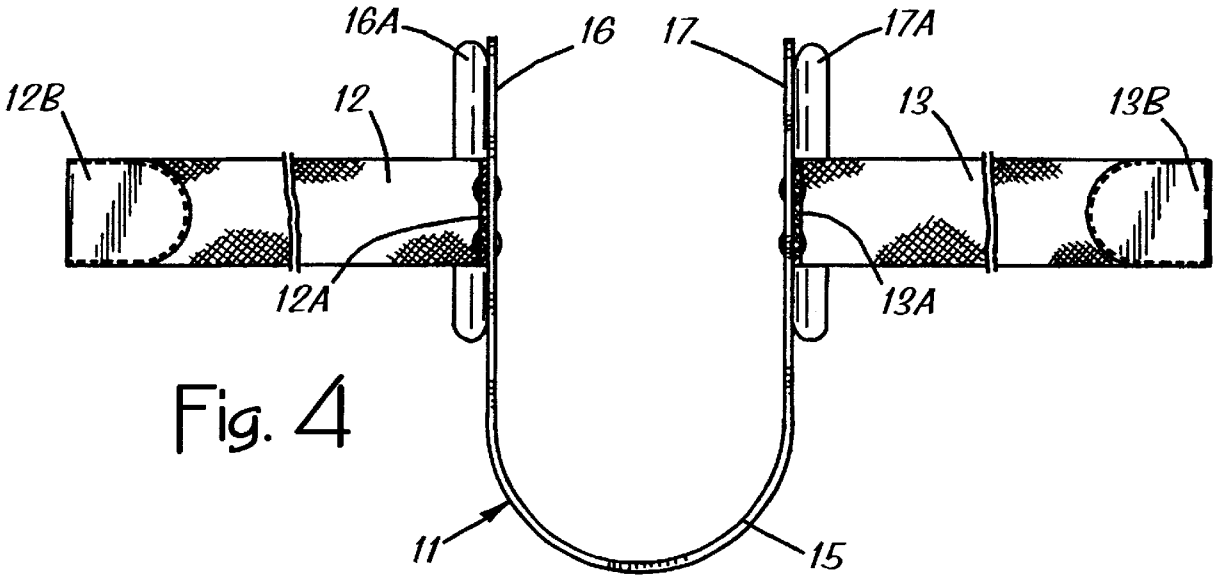
FIG. 4 is a plan view of the bottom.
Figure 5:
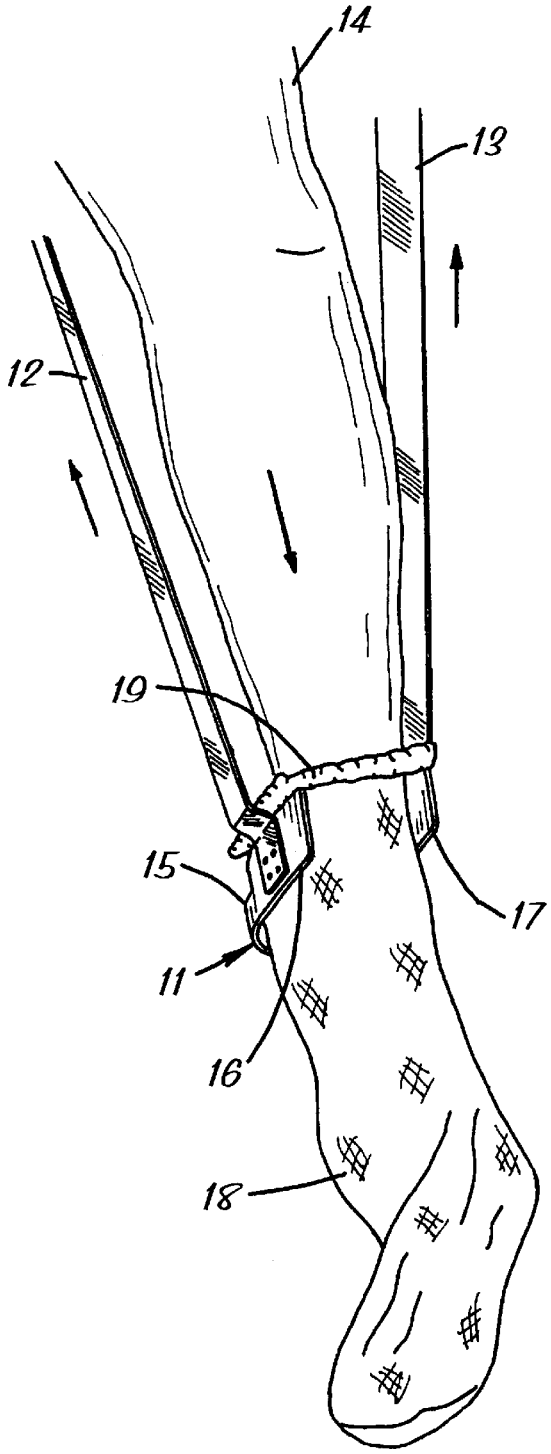
FIG. 5 is another isometric view showing a person using the dressing aid to don a sock.

FIGS. 1–5 of the drawings show various aspects of a sock holding dressing aid device 10 constructed according to the invention. Generally, the device 10 includes a sock-holding member or frame 11 together with first and second straps 12 and 13 attached to the frame member 11. The first strap 12 includes a first or distal end portion 12A (FIGS. 1, 3, 4, and 5) connected to the a first or right side of the frame 11 by suitable means (e.g., rivets), and an opposite or proximal end portion 12B that a user 14 grasps when using the device 10 as shown in FIG. 5. Similarly, the second strap 13 includes a first or distal end portion 13A connected to a second or left side of the frame 11 by suitable means, and an opposite or proximal end portion 13B that the user 14 grasps when using the device 10.

The frame 11 is a U-shaped member having a semicircularly shaped portion 15 (the base of a "U") and first (or right) and second (or left) straight portions 16 and 17 (the legs of the "U") extending in parallel spaced-apart positions from the semicircularly shaped portion 15. The first straight portion 16 includes a first or right sock-engaging flange 16A (FIGS. 1, 3, and 4) that protrudes sideways (to the right) beyond the rest of the first straight portion 16 and the distal end portion 12A of the strap 12. Similarly, the second straight section 17 includes a second sock-engaging flange 17A that protrudes sideways (to the left) beyond the rest of the first straight portion 16 and the distal end portion 13A of the strap 13.

The user 14 places a sock 18 on the sock-holding member 11 so that the cuff 19 of the sock 18 extends over the first and second sock-engaging flanges 16A and 17A as shown in FIG. 5. In order to do so, the user 14 manually forces the first and second straight portions 16 and 17 toward each other slightly in order to position the cuff of the sock over the first and second sock-engaging flanges 16A and 17A. The user then allows the sock-holding member to recover toward its usual shape and spring bias the cuff 19 of the sock 18 in an open configuration. The first and second straight portions 16 and 17 spring back toward their initial shape and that holds the cuff 19 of the sock 18 in a spread-apart open position.

Figure 6:
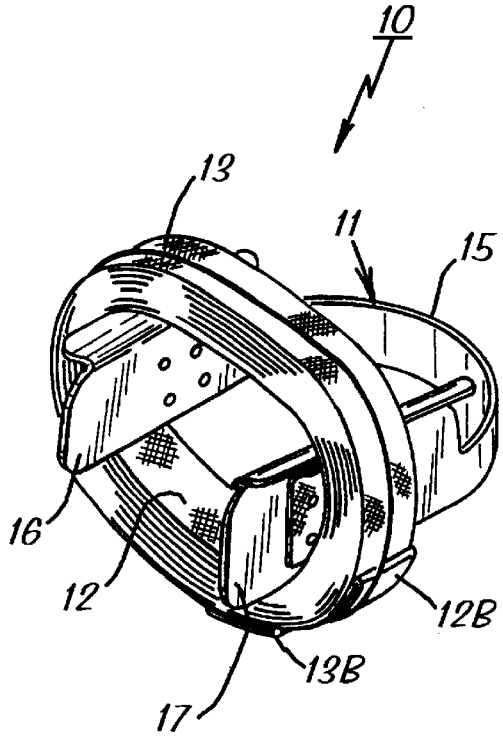
FIG. 6 is an isometric view showing the straps rolled up around the body of the dressing aid for storage.

With the sock 18 mounted on the device 10, the user manipulates his foot into the stock 18 while pulling on the straps 12 and 13. The user's foot moves downwardly into the sock 18 (as indicated by a downwardly directed arrow in FIG. 5) as the user 14 pulls upwardly on the straps 12 and 13 (as indicated by two upwardly directed arrows in FIG. 5). After donning the sock in that way, the user pulls the straps 12 and 13 rearwardly and downwardly slightly and that disengages the cuff 19 from the first and second sock-engaging flanges 16A and 16B. The user 14 then rolls up the straps 12 and 13 around the frame 11 into a compact storage configuration shown in FIG. 6 . . . a configuration that readily fits in the user's dresser drawer or the users luggage. An elastic member 20 (e.g., a rubber band) holds the straps 12 and 13 in the storage configuration.

As a further idea of size and construction, the frame 11 of the illustrated device 10 is fabricated from 1/16" thick stainless steel material. Other generally rigid but resiliently deformable materials may be used instead for the frame. The semicircularly shaped portion 15 of the frame 11 is about 3/4" wide, while the first and second straight portions 16 and 17 are about 1.75" wide and 3.5" long. The first and second straight portions 16 and 17 are spaced apart about 3.5" and they protrude sideways (away from each other) about 0.25". Constructed that way, the first and second straight portions 16 and 17 can each spring about 1.0" sideways (toward and away from each other) from their usual at rest, recovered positions. The straps 12 and 13 are flexible strap material (e.g., wool straps), each measuring about 1.0" wide and 28" long. They are attached to the frame 11 with metal rivets. Of course, the foregoing precise details may vary without departing from the inventive concepts described and claimed. Based upon the foregoing description and the drawings, one of ordinary skill in the art can readily implement a sock holding dressing aid according to the invention.

Thus, the invention provides a sock holder having better combination of feel, functionality, ease of use, cost, and appearance. The cuff-engaging flanges are easy to position so that they securely hold the cuff of a sock open, while being easily removed from the cuff once the sock is on the user's foot. The flexible straps are convenient to use in pulling the sock onto the foot, while being readily rolled up around the U-shaped member for storage in a compact configuration suitable for the dresser drawer or luggage. Although an exemplary embodiment has been shown and described, one of ordinary skill in the art may make many changes, modifications, and substitutions without necessarily departing from the spirit and scope of the invention.

What is claimed is:

1. A sock-holding dressing aid for a person to use in donning a sock having a cuff onto a foot of the person, comprising:

means for holding the cuff of the sock in an expanded position ahead of the foot of the user without inserting said means into the sock in order to facilitate insertion of the foot into the sock, said means including a U-shaped member having a semicircularly shaped base portion and first and second side portions extending forwardly from the semicircularly shaped base portion such that the person can place the U-shaped member in a circumscribing relationship to the cuff of the sock with the first and second side portions alongside opposite sides of the cuff of the sock; and means for enabling the person to pull the U-shaped member toward the person in order to pull the sock onto the foot of the person without the person having to bend over toward the foot;

wherein the means for enabling the person to pull the U-shaped member toward the person includes first and second straps connected to respective ones of the first and second side portions of the U-shaped member, which first and second straps are composed of a flexible material such that the user can wind the straps around the U-shaped member into a storage configuration; and wherein the U-shaped member includes means for gripping the cuff of the sock without inserting the U-shaped member into the sock, said means including a first flange extending sidewardly from the first side portion of the U-shaped member and a second flange extending sidewardly from the second side portion of the U-shaped member so that the user can loop the cuff of the sock over the first and second flanges without inserting the U-shaped member into the sock, said first and second flanges being smooth without pointed indentations.

2. A sock-holding dressing aid as recited in claim 1, wherein the U-shaped member is composed of a resiliently deformable material such that the user can resiliently deform the U-shaped member slightly from a non-deformed shape in order to place the cuff of the sock over the flanges, and then allow the U-shaped member to recover toward the non-deformed shape and thereby hold the cuff in the expanded position.

3. A sock-holding dressing aid as recited in claim 2, wherein the U-shaped member is composed of metal.

4. A sock-holding dressing aid as recited in claim 3, wherein the first and second straps are composed of a textile fabric.

5. A sock-holding dressing aid for a person to use in donning a sock having a cuff onto a foot of the person, comprising:

means for holding the cuff of the sock in an expanded position ahead of the foot of the user without inserting said means into the sock in order to facilitate insertion of the foot into the sock, said means including a forwardly opening U-shaped member composed of a resiliently deformable material, the U-shaped member having a rearwardly disposed semicircularly shaped base portion and spaced apart first and second side portions extending forwardly from the semicircularly shaped base portion such that the person can place the U-shaped member in a circumscribing relationship to the cuff of the sock with the first and second side portions alongside opposite sides of the cuff of the sock; and means for enabling the person to pull the U-shaped member toward the person in order to pull the sock onto the foot of the person without the person having to bend over toward the foot, said means including first and second straps connected to the U-shaped member, which first and second straps are composed of a flexible textile fabric material such that the user can wind the straps around the U-shaped member into a storage configuration;

wherein the U-shaped member includes means for gripping the cuff of the sock without inserting the U-shaped member into the sock, said means including a first flange extending sidewardly to the right from the first side portion of the U-shaped member and a second flange extending sidewardly to the left from the second side portion of the U-shaped member so that the user can loop the cuff of the sock over the first and second flanges without inserting the U-shaped member into the sock, said first and second flanges being smooth without pointed indentations.

* * * * *